US011898472B1

(12) United States Patent
Mlinaric

(10) Patent No.: US 11,898,472 B1
(45) Date of Patent: Feb. 13, 2024

(54) HYDRAULICALLY LOCKABLE VARIABLE CAMSHAFT PHASER

(71) Applicant: Schaeffler Technologies AG & Co. KG, Herzogenaurach (DE)

(72) Inventor: Andrew Mlinaric, Lakeshore (CA)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 18/206,366

(22) Filed: Jun. 6, 2023

(51) Int. Cl.
*F01L 1/344* (2006.01)
*F01L 1/46* (2006.01)

(52) U.S. Cl.
CPC ..... *F01L 1/3442* (2013.01); *F01L 1/46* (2013.01); *F01L 2001/3443* (2013.01); *F01L 2001/34423* (2013.01); *F01L 2001/34456* (2013.01)

(58) Field of Classification Search
CPC ..... F01L 1/3442; F01L 2001/34423; F01L 2001/3443; F01L 2001/34456; F01L 1/46
USPC ..... 123/90.15, 90.17
See application file for complete search history.

(56) References Cited

U.S. PATENT DOCUMENTS 6,644,258 B1 11/2003 Smith
6,647,936 B2 11/2003 Lewis
6,684,835 B2 2/2004 Komazawa et al.
6,761,138 B2 * 7/2004 Takahashi ..... F01L 1/3442 123/90.15
8,356,583 B2 1/2013 Smith
9,638,109 B2 5/2017 Watanabe
9,957,851 B2 5/2018 Takahata et al.
10,598,053 B2 3/2020 Moetakef
11,015,491 B2 5/2021 Nichols et al.
2002/0129781 A1 * 9/2002 Kinugawa ..... F01L 1/3442 123/90.15
2007/0107684 A1 * 5/2007 Takahashi ..... F01L 1/022 123/90.15
2013/0180486 A1 * 7/2013 Smith ..... F01M 9/10 123/90.17
2021/0277808 A1 9/2021 Kenyon

FOREIGN PATENT DOCUMENTS

DE 102012209602 A1 * 12/2012 ..... F01L 1/3442
DE 102015106262 B3 9/2016

* cited by examiner

*Primary Examiner* — Jorge L Leon, Jr.
(74) *Attorney, Agent, or Firm* — Davidson, Davidson & Kappel, LLC

(57) ABSTRACT

A camshaft phaser for an internal combustion engine includes a stator defining a receptacle therein. The stator includes a ring and a plurality of webs extending radially inward from the ring. The camshaft phaser also includes a rotor rotatable with respect to the stator and received inside the receptacle. The rotor includes a center section and a plurality of vanes extending radially outward from the center section. The center section abuts the webs to define chambers circumferentially between the webs. Each of the vanes is positioned in one of the chambers and sealingly engaging an inner circumferential surface of the ring. At least one of the chambers is a locking chamber and at least one the vanes is a locking vane positioned in the locking chamber. The camshaft phaser also includes a locking valve in the locking vane configured to allow fluid to enter into the locking chamber and to prevent fluid from flowing out of the locking chamber to lock the rotor with respect to the stator in a locked orientation.

19 Claims, 5 Drawing Sheets

HYDRAULICALLY LOCKABLE VARIABLE CAMSHAFT PHASER

The present disclosure relates generally to motor vehicle camshaft phaser and more specifically to fluid systems in motor vehicle drivetrains.

BACKGROUND

Hydraulic cam phasers utilize a mechanical locking pin to hold a camshaft phaser in a fixed position during engine shutdown or a failsafe scenario.

SUMMARY

A camshaft phaser for an internal combustion engine includes a stator defining a receptacle therein. The stator includes a ring and a plurality of webs extending radially inward from the ring. The camshaft phaser also includes a rotor rotatable with respect to the stator and received inside the receptacle. The rotor includes a center section and a plurality of vanes extending radially outward from the center section. The center section abuts the webs to define chambers circumferentially between the webs. Each of the vanes is positioned in one of the chambers and sealingly engaging an inner circumferential surface of the ring. At least one of the chambers is a locking chamber and at least one the vanes is a locking vane positioned in the locking chamber. The camshaft phaser also includes a locking valve in the locking vane configured to allow fluid to enter into the locking chamber and to prevent fluid from flowing out of the locking chamber to lock the rotor with respect to the stator in a locked orientation.

In examples, the locking vane includes a locking port extending from the center section to the locking valve to provide fluid through the locking valve into the locking chamber.

In examples, the locking vane further includes a first pressurization port extending from the center section through the locking vane and configured for supplying fluid in a first circumferential direction into the locking chamber.

In examples, the locking vane further includes a second pressurization port extending from the center section through the locking and configured for supplying fluid in a second circumferential direction into the locking chamber, the second circumferential direction being opposite of the first circumferential direction.

In examples, the camshaft phaser is configured to set a rotational configuration of the rotor during operation of the camshaft phaser by supplying fluid to at least one of the first pressurization port and the second pressurization port.

In examples, the camshaft phaser is configured to lock the rotor with respect to the stator in a locked orientation during engine shutdown or a failsafe scenario of the camshaft phaser by supplying fluid to the locking port.

In examples, the locking port is configured for supplying fluid in the second circumferential direction into the locking chamber.

In examples, the locking valve is a check valve.

In examples, in the locking position, the locking vane is positioned circumferentially in contact with one of the webs delimiting the locking chamber.

In examples, the camshaft phaser does not include a mechanical locking device for rotationally fixing the rotor in place with respect to the stator.

In examples, the camshaft phaser further includes a control valve for controlling a flow of pressurized fluid from a pump into the locking port, the locking valve configured for being in locked position when the control valve is in a deactivated orientation.

In examples, the camshaft phaser further includes a first pressurization port extending from the center section through the locking vane and configured for supplying fluid in a first circumferential direction into the locking chamber; and a second pressurization port extending from the center section through the locking and configured for supplying fluid in a second circumferential direction into the locking chamber, the second circumferential direction being opposite of the first circumferential direction, the control valve being selectively actuatable to control the flow of pressurized fluid from the pump into the locking port, the first pressurization port and the second pressurization port.

In examples, the control valve is configured to fluidically connect the locking port to the pump when the control valve is in the deactivated orientation.

In examples, the control valve is configured to fluidically connect the first pressurization port to the pump when the control valve is in a first activated orientation, and the control valve is configured to fluidically connect the second pressurization port to the pump when the control valve is in a second activated orientation.

In examples, a valve body of the control valve is in: an initial position in the deactivated orientation of the control valve, a first position that is a first distance from the initial position in the first activated orientation of the control valve, and a second position that is a second distance from the initial position in the second activated orientation in the first activated orientation.

In examples, the second pressurization port is connected to a fluid tank in the deactivated orientation of the control valve.

In examples, the first pressurization port and the second pressurization port are disconnected from the pump in the deactivated orientation of the control valve.

In examples, the second pressurization port is disconnected from the pump in the first activated orientation of the control valve, and the first pressurization port is disconnected from the pump in the second activated orientation of the control valve.

In examples, the control valve includes a solenoid actuator and the solenoid actuator is de-energized in the deactivated orientation of the control valve.

A method of operating the camshaft phaser can include energizing the solenoid actuator to move the control valve into a first activated orientation to hydraulically displace the rotor in a first circumferential direction, and/or energizing the solenoid actuator to move the control valve into a second activated orientation to hydraulically displace the rotor in a second circumferential direction opposite the first circumferential direction; and de-energizing the solenoid actuator, the de-energizing of the solenoid actuator causing fluid to flow through the control valve into the locking chamber to lock the rotor with respect to the stator.

BRIEF DESCRIPTION OF THE DRAWINGS

The present disclosure is described below by reference to the following drawings, in which.

DETAILED DESCRIPTION

Figure 1:
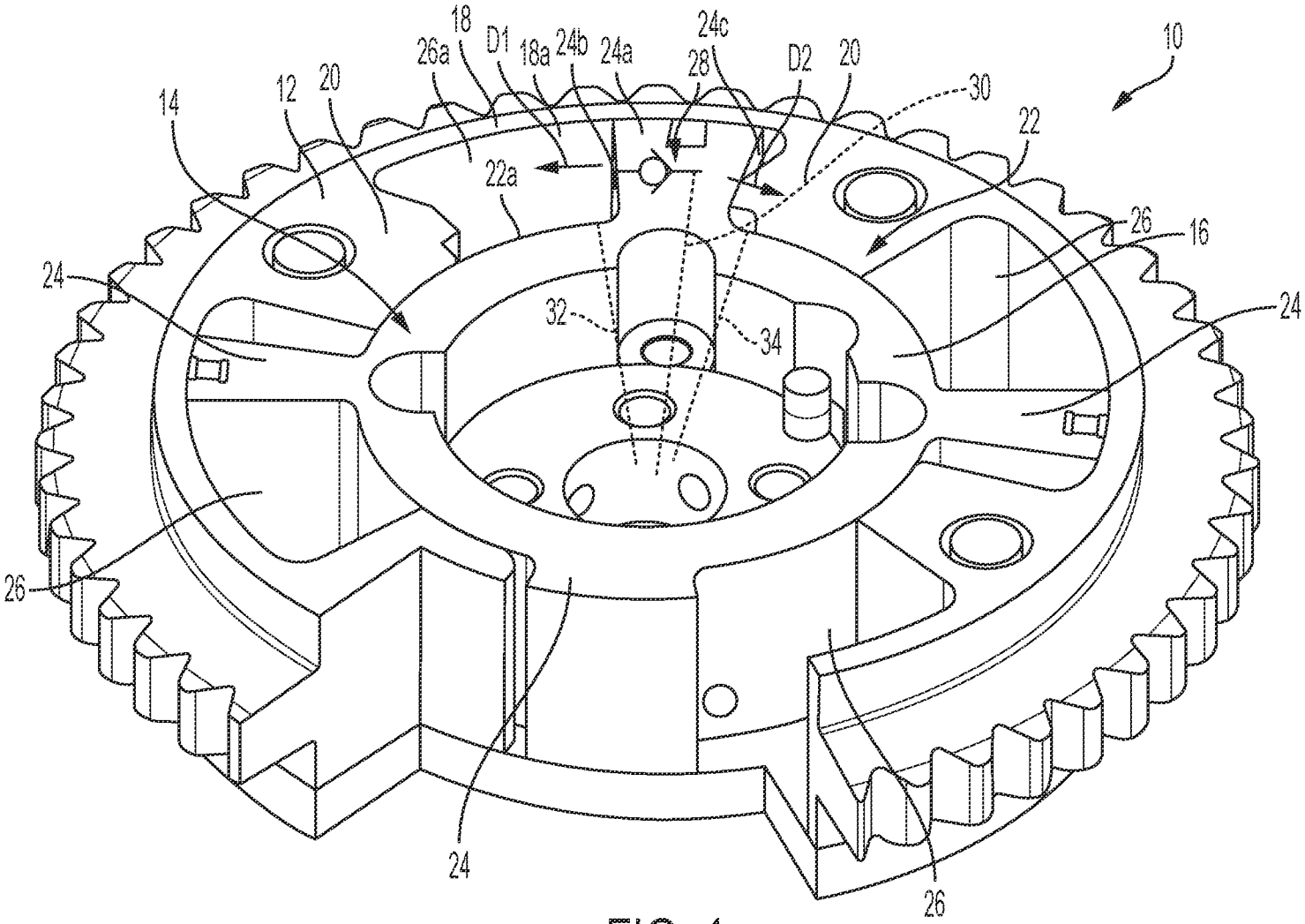
FIG. 1 shows a camshaft phaser for an internal combustion engine according to the present disclosure.

FIG. 1 shows a camshaft phaser 10 for an internal combustion engine. The camshaft phaser 10 includes a stator 12 defining a receptacle 14 therein and a rotor 16 rotatable with respect to the stator 12 and received inside the receptacle 14. The stator 12 including a ring 18 and a plurality of webs 20 extending radially inward from the ring 18. The rotor 16 includes a center section 22 and a plurality of vanes 24 extending radially outward from the center section 22. The center section 22 abuts the webs 20 to define chambers 26 circumferentially between the webs 20. Each of the vanes 24 is positioned in one of the chambers 26 and sealingly engages an inner circumferential surface 18*a* of the ring 18. At least one of the chambers 26 is a locking chamber 26*a* and at least one the vanes 24 is a locking vane 24*a* positioned in the locking chamber 26*a*.

The camshaft phase 10 also includes a locking valve 28 in the locking vane 24*a* configured to allow fluid to enter into the locking chamber 26*a* and to prevent fluid from flowing out of the locking chamber 26*a* to lock the rotor 16 with respect to the stator 12 in a locked orientation. In the embodiment shown in FIG. 1, the locking valve 28 is a check valve that allows fluid to flow out of the locking vane 24*a* into the locking chamber 26*a*, but prevents fluid from the locking chamber 26*a* from flowing through the locking valve 28 and back into the locking vane 24*a*. Unlike a conventional camshaft phaser, the camshaft phaser 10 does not include a mechanical locking device, such as a locking pin, for rotationally fixing the rotor 16 in place with respect to the stator 12.

The locking vane 24*a* includes a locking port 30 extending from the center section 22 to the locking valve 28 to provide fluid through the locking valve 28 into the chamber. The locking vane 24*a* further includes a first pressurization port 32 extending radially from an interior of the center section 22 to the outer circumferential surface 22*a* of the center section 22 and configured for supplying fluid into the area of locking chamber 26*a* facing a first circumferentially facing side 24*b* of the locking vane 24*a*, and a second pressurization port 34 extending radially from an interior of the center section 22 to the outer circumferential surface 22*a* of the center section 22 and configured for supplying fluid into the area of locking chamber 26*a* facing a second circumferentially facing side 24*c* of the locking vane 24*a*.

The camshaft phaser 10 is configured to set a rotational configuration of the rotor 16 during operation of the camshaft phaser 10 by selectively supplying fluid to at least one of the first pressurization port 32 and the second pressurization port 34. The fluid supplied to the first pressurization port 32 flows into the area of locking chamber 26*a* facing the first circumferentially facing side 24*b* of the locking vane 24*a*, which cause the locking vane 24*a*, and the rotor 16 as a whole, to rotate in a second circumferential direction D2. The fluid supplied to the second pressurization port 34 flows into the area of locking chamber 26*a* facing a second circumferentially facing side 24*c* of the locking vane 24*a*, which cause the locking vane 24*a*, and the rotor 16 as a whole, to rotate in a first circumferential direction D1 opposite of the second circumferential direction D2.

The camshaft phaser 10 is also configured to lock the rotor 16 with respect to the stator 12 in a locked orientation during engine shutdown or a failsafe scenario of the camshaft phaser 10 by supplying fluid to the locking port 30. A failsafe scenario is defined as a scenario when power is not provided to the control valve 36 of camshaft phaser 10. The locking port 30 is configured for supplying fluid into the locking chamber 26*a*. In the locking position, the locking vane 24*a* is positioned circumferentially in contact with one of the webs 20 delimiting the locking chamber 26*a*. In particular, in the locking position, the locking vane 24*a* is positioned circumferentially in contact with the web 20 facing the second circumferentially facing side 24*c* of the locking vane 24*a*.

Figure 2A:
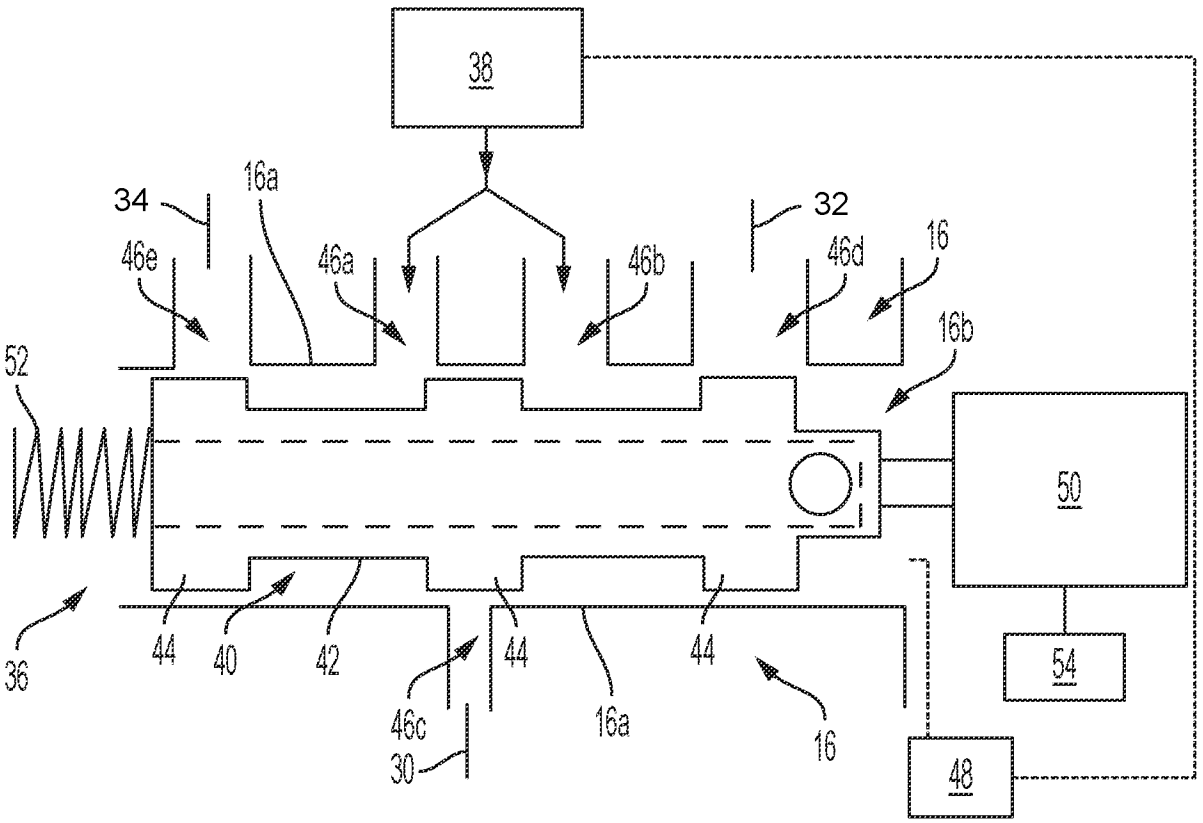
FIG. 2*a* schematically shows a control valve of the camshaft phaser for controlling a flow of pressurized fluid from a pump into ports of a rotor of the camshaft phaser.

As shown schematically in FIG. 2*a*, the camshaft phaser 10 also includes a control valve 36 for controlling a flow of pressurized fluid from a pump 38 into the locking port 30. Control valve 36 can be positioned radially inside of center section 22. The locking valve 28 is configured for being in a locked position when the control valve 36 is in a deactivated orientation. In an example, the control valve 36 includes a solenoid actuator and the solenoid actuator is de-energized in the deactivated orientation of the control valve 36. The control valve 36 is selectively actuatable to control the flow of pressurized fluid from the pump 38 into the locking port 30, the first pressurization port 32 and the second pressurization port 34.

Valve body 40 has a cylindrical base 42 including a plurality of disc shaped blocking sections 44 extending radially outward from the base 42. Blocking sections 44 are aligned with port openings formed in an inner circumferential surface 16*a* of rotor 16. In particular, inner circumferential surface 16*a* includes a first pump opening 46*a*, a second pump opening 46*b*, a locking port opening 46*c*, a first pressurization port opening 46*d* and a second pressurization port opening 46*e*. The valve body 40 is positioned within a bore 16*b*, which is defined by inner circumferential surface 16*a*, and bore 16*b* is connected to a fluid tank 48. Pump 38 pumps fluid from the fluid tank 48. First pump opening 46*a* and second pump opening 46*b* are fluidically coupled to pump 38 for pumping fluid into ports 32, 34, 36 via locking port opening 46*c*, first pressurization port opening 46*d* and second pressurization port opening 46*e* depending on the orientation of control valve 36. Depending on the position of valve body 40, the fluid can also flow out of first pressurization port 32 and second pressurization port 34 into the fluid tank 48.

Control valve 36 further includes an electromagnetic actuator 50 for moving valve body 40 linearly, and a return spring 52 for returning valve body 40 to a setpoint position when electromagnetic actuator 50 is de-energized. Electromagnetic actuator 50 is a solenoid actuator and includes a coil that is energized to create a magnetic field, which pulls a plunger or a piston to move valve body 40. Electromagnetic actuator 50 can be controlled by a controller 54. For example, control valve 36 can be controlled by controller 54 to multiple positions by using pulse width modulation (PWM). In the example shown in FIGS. 3*a* to 6*b*, valve body 40 of control valve 36 has four different positions—one deactivated position as schematically illustrated in FIGS. 3*a*, 3*b*, and three activated positions as schematically illustrated in FIGS. 4*a* to 6*b*.

Figure 2B:
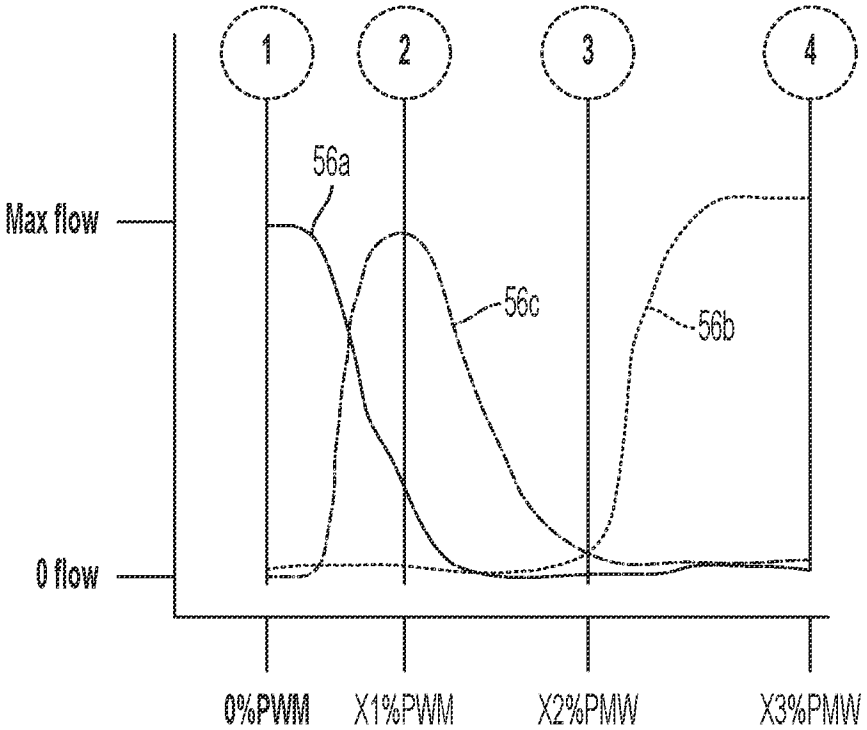
FIG. 2*b* shows a graph illustrating the flow of fluid from the pump into each port of the rotor.

FIG. 2*b* shows a graph illustrating the flow of fluid from the pump 38 into each of the ports 30, 32, 34. The graph plots the flow rate from the pump 38 to ports 30, 32, 34 versus a pulse width modulation percentage of electromagnetic actuator 50 by controller 54. A first flow curve 56*a* represents a fluid flowing from the pump 38 into the locking port 30, second curve 56*b* represents a fluid flowing from the pump 38 into the first pressurization port 32 and a third curve 56*c* represents a fluid flowing from the pump 38 into the second pressurization port 34.

Figure 3B:
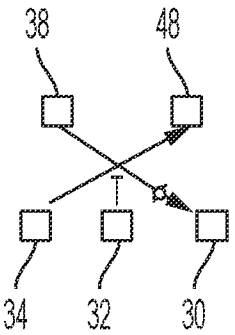
FIG. 3*b* schematically illustrates the flow of fluid in the deactivated orientation of the control valve.
Figure 3A:
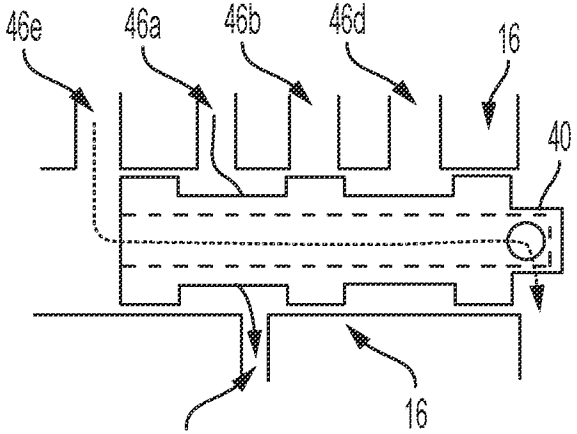
FIG. 3*a* schematically illustrates that a valve body on the control valve is in an initial position in a deactivated orientation of the control valve.

As shown schematically in FIGS. 3*a* and 3*b*, the control valve 36 is configured to fluidically connect the locking port 30 to the pump 38 when the control valve 36 is in the deactivated orientation. The deactivated orientation corresponds to a 0% PMW in FIG. 2*b*. The first pressurization port 32 and the second pressurization port 34 are disconnected from the pump 38 in the deactivated orientation of the control valve 36. FIG. 3*a* illustrates that the valve body 40 is in an initial position in the deactivated orientation of the control valve 36. FIG. 3*a*, 3*b* illustrate that the second pressurization port 34 is connected to fluid tank 48 such that fluid has flowed out of second pressurization port 34 into the fluid tank 48, and that fluid has been pumped by the pump 38 into the locking port 30, which locks the rotor 16 in the locked orientation.

Figure 4B:
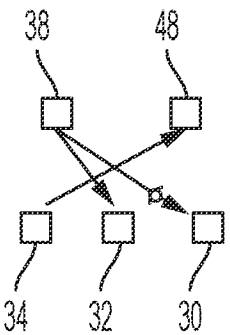
FIG. 4*b* schematically illustrates the flow of fluid in the first activated orientation of the control valve.
Figure 4A:
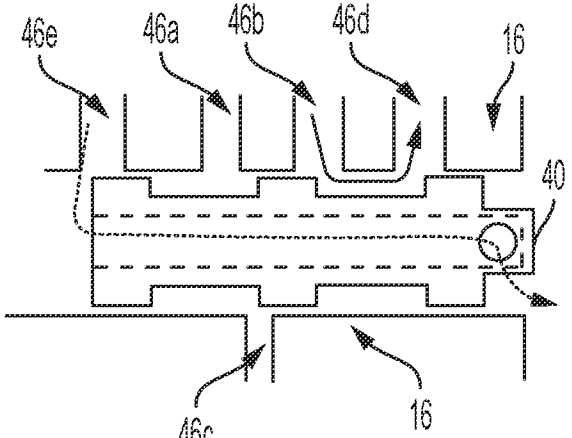
FIG. 4*a* schematically illustrates that the valve body on the control valve is in a first position in a first activated orientation of the control valve.

As shown schematically in FIGS. 4*a* and 4*b*, the control valve 36 is configured to fluidically connect the first pressurization port 32 and the locking port 30 to the pump 38 when the control valve 36 is in a first activated orientation. The first activated orientation corresponds to a X1% PMW in FIG. 2*b*, such that the piston of electromagnetic actuator 50 has been actuated a first distance, which caused the valve body 40 to be in a first position that is a first distance from the initial position in the first activated orientation of the control valve 36. The second pressurization port 34 is disconnected from the pump 38 in the first activated orientation of the control valve 36. FIG. 4*a*, 4*b* illustrate that the fluid tank 48 is connected to the second pressurization port 34 such that fluid is not being pumped into the second pressurization port 34, and that fluid has been pumped by the pump 38 into the first pressurization port 32.

Figure 5B:
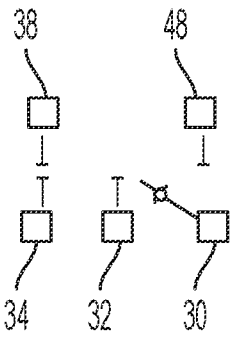
FIG. 5*b* schematically illustrates the flow of fluid in the intermediate activated orientation of the control valve.
Figure 5A:
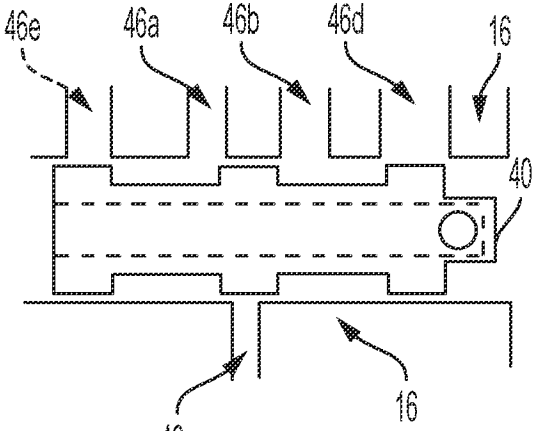
FIG. 5*a* schematically illustrates that the valve body on the control valve is in an intermediate position in an intermediate activated orientation of the control valve.

As shown schematically in FIGS. 5*a* and 5*b*, the control valve 36 is configured to fluidically block all of ports 30, 32, 34 from the pump 38 when the control valve 36 is in an intermediate activated orientation. The intermediate activated orientation corresponds to a X2% PMW in FIG. 2*b*, such that the piston of electromagnetic actuator 50 has been actuated an intermediate distance, which caused the valve body 40 to be in an intermediate position that is an intermediate distance from the initial position in the intermediate activated orientation of the control valve 36.

Figure 6B:
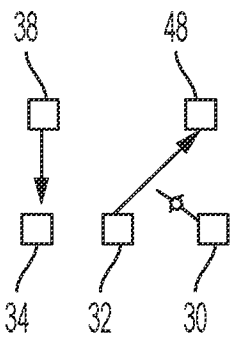
FIG. 6*b* schematically illustrates the flow of fluid in the second activated orientation of the control valve.
Figure 6A:
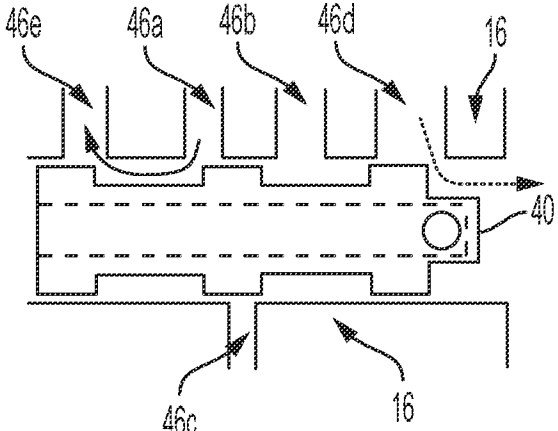
FIG. 6*a* schematically illustrates that the valve body on the control valve is in a second position in a second activated orientation of the control valve.

As shown schematically in FIGS. 6*a* and 6*b*, the control valve 36 is configured to fluidically connect the second pressurization port 34 to the pump 38 when the control valve 36 is in a second activated orientation. The second activated orientation corresponds to a X3% PMW in FIG. 2*b*, such that the piston of electromagnetic actuator 50 has been actuated a second distance, which caused the valve body 40 to be in a second position that is a second distance from the initial position in the second activated orientation of the control valve 36. The first pressurization port 32 and the locking port 30 are disconnected from the pump 38 in the second activated orientation of the control valve 36.

Referring to all of the figures together, a method of operating the camshaft phaser 10 includes energizing the control valve 36 to hydraulically displace the rotor 16 in a first circumferential direction, and/or energizing the control valve 36 to hydraulically displace the rotor 16 in a second circumferential direction opposite the first circumferential direction. The method also includes de-energizing the control valve 36. The de-energizing of the control valve 36 causes fluid to flow through the control valve 36 into the locking chamber 26*a* to lock the rotor 16 with respect to the stator 12.

In the preceding specification, the present disclosure has been described with reference to specific exemplary embodiments and examples thereof. It will, however, be evident that various modifications and changes may be made thereto without departing from the broader spirit and scope of present disclosure as set forth in the claims that follow. The specification and drawings are accordingly to be regarded in an illustrative manner rather than a restrictive sense.

LIST OF REFERENCE NUMBERS

10 camshaft phaser
12 stator
14 receptacle
16 rotor
16*a* inner circumferential surface
16*b* bore
18 ring
18*a* inner circumferential surface
20 webs
22 center section
22*a* outer circumferential surface of the center section
24 vanes
24*a* locking vane
24*b* first circumferentially facing side
24*c* second circumferentially facing side
26 chambers
26*a* locking chamber
28 locking valve
30 locking port
32 first pressurization port
34 second pressurization port
36 control valve
38 pump
40 valve body
42 cylindrical base
44 plurality of disc shaped blocking sections
46*a* first pump opening
46*b* second pump opening
46*c* locking port opening
46*d* first pressurization port opening
46*e* second pressurization port opening
48 fluid tank
50 electromagnetic actuator
52 return spring
54 controller

56*a* first flow curve

56*b* second curve

56*c* third curve

What is claimed is:

1. A camshaft phaser for an internal combustion engine, the camshaft phaser comprising:

a stator defining a receptacle, the stator including a ring and a plurality of webs extending radially inward from the ring;

a rotor rotatably received inside the receptacle, the rotor including a center section and a plurality of vanes extending radially outward from the center section, the center section abutting the plurality of webs so as to define a chamber between adjacent pairs of webs of the plurality of webs, each vane respectively associated with each chamber so as to sealingly engage an inner circumferential surface of the ring, at least one of the chambers being a locking chamber and the associated vane of each locking chamber being a locking vane; and a locking valve arranged in each locking vane, the locking valve configured to enable fluid to enter the locking chamber and to prevent the fluid from flowing out of the locking chamber so as to rotationally lock the rotor with respect to the stator in a locked orientation, wherein the camshaft phaser does not include a mechanical locking device for rotationally locking the rotor with respect to the stator.

2. The camshaft phaser as recited in claim 1 wherein each locking vane includes a locking port extending from the center section to the locking valve so as to provide the fluid to the locking chamber via the locking valve.

3. The camshaft phaser as recited in claim 2 wherein each locking vane divides the locking chamber into a first area and a second area, and wherein each locking vane further includes a first pressurization port extending from the center section through the locking vane, the first pressurization port configured to supply the fluid directly into the first area of locking chamber.

4. The camshaft phaser as recited in claim 3 wherein each locking vane further includes a second pressurization port extending from the center section through the locking vane, the second pressurization port configured to supply the fluid directly into the second area of locking chamber.

5. The camshaft phaser as recited in claim 4 wherein a rotational configuration of the rotor with respect to the stator is set by supplying the fluid to at least one of (i) the first area via the first pressurization port, and (ii) the second area via the second pressurization port.

6. The camshaft phaser as recited in claim 4 wherein the rotor is moved into the locked orientation during engine shutdown or a failsafe scenario of the camshaft phaser by supplying the fluid to the locking chamber via the locking port.

7. The camshaft phaser as recited in claim 4 wherein the locking port is configured to supply the fluid in a circumferential direction into the locking chamber.

8. The camshaft phaser as recited in claim 1 wherein the locking valve is a check valve.

9. The camshaft phaser as recited in claim 1 wherein, in the locked orientation, each locking vane abuts with one web of the adjacent pair of webs delimiting the locking chamber.

10. The camshaft phaser as recited in claim 1 wherein each locking vane includes a locking port extending from the center section to the locking valve so as to provide the fluid to the locking chamber via the locking valve, and wherein the camshaft phaser further comprises a control valve configured to control a flow of pressurized fluid from a pump to each locking port.

11. The camshaft phaser as recited in claim 10, wherein each locking vane divides the locking chamber into a first area and a second area, each locking vane further including:

a first pressurization port extending from the center section through the locking vane, the first pressurization port configured to supply the fluid directly into the first area of locking chamber; and a second pressurization port extending from the center section through the locking vane, the second pressurization port configured to supply the fluid into the second area of locking chamber, wherein the control valve is further configured to control the flow of pressurized fluid from the pump to each first pressurization port and each second pressurization port.

12. The camshaft phaser as recited in claim 11 wherein the control valve is configured to fluidically connect the pump to each locking port when the control valve is in a deactivated orientation.

13. The camshaft phaser as recited in claim 12 wherein the control valve is configured to fluidically connect the pump to each first pressurization port when the control valve is in a first activated orientation, and wherein the control valve is configured to fluidically connect the pump to each second pressurization port when the control valve is in a second activated orientation.

14. The camshaft phaser as recited in claim 13 wherein the control valve includes a valve body, wherein the deactivated orientation of the control valve corresponds to an initial position of the valve body, wherein the first activated orientation of the control valve corresponds to a first position of the valve body which is a first distance from the initial position, and wherein the second activated orientation of the control valve corresponds to a second position of the valve body which is a second distance from the initial position.

15. The camshaft phaser as recited in claim 14 wherein each second pressurization port is connected to a fluid tank in the deactivated orientation of the control valve.

16. The camshaft phaser as recited in claim 13 wherein the first pressurization port and the second pressurization port are disconnected from the pump in the deactivated orientation of the control valve.

17. The camshaft phaser as recited in claim 13 wherein each second pressurization port is disconnected from the pump in the first activated orientation of the control valve, and each first pressurization port is disconnected from the pump in the second activated orientation of the control valve.

18. The camshaft phaser as recited in claim 12 wherein the control valve includes a solenoid actuator configured to be de-energized in the deactivated orientation of the control valve.

19. A method of operating the camshaft phaser as recited in claim 18, the method comprising:

energizing the solenoid actuator into a first activated orientation so as to hydraulically displace the rotor in a first rotational direction, and/or energizing the solenoid actuator into a second activated orientation so as to hydraulically displace the rotor in a second rotational direction opposite the first rotational direction; and de-energizing the solenoid actuator, such that the fluid flows through the control valve and into the locking chamber so as to rotationally lock the rotor with respect to the stator.

* * * * *